United States Patent [19]

Bandyopadhyay et al.

[11] 3,999,606

[45] Dec. 28, 1976

[54] OIL RECOVERY RATE BY THROTTLING PRODUCTION WELLS DURING COMBUSTION DRIVE

[75] Inventors: Pratip Bandyopadhyay; Vaughan W. Rhoades, both of Tulsa, Okla.

[73] Assignee: Cities Service Company, Tulsa, Okla.

[22] Filed: Oct. 6, 1975

[21] Appl. No.: 619,726

[52] U.S. Cl. ..... 166/245; 166/261

[51] Int. Cl.[2] ..... E21B 43/24

[58] Field of Search ..... 166/256, 251, 245, 261, 166/263

[56] References Cited

UNITED STATES PATENTS

| | | | |
|---|---|---|---|
| 2,390,770 | 12/1945 | Barton et al. | 166/251 |
| 2,642,943 | 6/1953 | Smith | 166/261 |
| 2,734,579 | 2/1956 | Elkins | 166/261 X |
| 2,788,071 | 4/1957 | Pelzer | 166/261 |
| 3,150,715 | 9/1964 | Dietz | 166/261 |
| 3,171,479 | 3/1965 | Parrish et al. | 166/261 |
| 3,196,945 | 7/1965 | Craig, Jr. et al. | 166/261 |
| 3,332,480 | 7/1967 | Parrish | 166/256 X |
| 3,434,541 | 3/1969 | Cook et al. | 166/256 |

*Primary Examiner*—Stephen J. Novosad
*Attorney, Agent, or Firm*—A. Joe Reinert

[57] ABSTRACT

In a combustion process for recovering hydrocarbons from a subterranean formation vertically traversed by an injection well through which an oxygen-containing gas is injected and a plurality of production wells through which liquid hydrocarbons and gaseous products of combustion are produced; oil recovery is improved by throttling of the production wells to increase the steam pressure in the locus ahead of the combustion zone, and according to a preferred mode, the combustion front advance is controlled by selectively throttling and increasing the gas pressure of production wells in the vicinity of the greatest advance of the combustion front.

5 Claims, No Drawings

OIL RECOVERY RATE BY THROTTLING PRODUCTION WELLS DURING COMBUSTION DRIVE

BACKGROUND OF THE INVENTION

1. Field of the Invention

This invention relates to improved recovery of hydrocarbons from a subterranean formation by a combustion process (fireflooding). In one aspect, the invention relates to an improved combustion process wherein the oil recovery rate is improved by increasing the pressure in the locus ahead of the combustion zone, as by throttling the production wells. In another aspect, the invention relates to an improved combustion process wherein the improvement involves a selective retarding of combustion front movement by throttling to increase produced gas pressure from at least one of a plurality of production wells which produce liquid hydrocarbons and gaseous products of combustion.

2. Brief Description of the Prior Art

A great need exists for increased production of hydrocarbons to meet increasing demands in the face of rapidly depleting reserves. One of the more promising approaches to solving this need involves enhanced recovery methods. Thermal recovery methods, in particular, in situ combustion methods, provide one means of recovering vast reserves of heavy petroleum deposits including tar sands and other reservoirs containing high viscosity materials which are not economically recoverable by other means.

U.S. Pat. Nos. 3,153,448; 3,208,519; 2,994,375; 3,171,479; 3,024,841 and 3,196,945 are exemplary disclosures of meritorious processes for the recovery of heavy hydrocarbons by thermal methods, in particular by in situ combustion methods (fireflooding).

Thus, it is known to recover hydrocarbons from a hydrocarbon-bearing subterranean formation, in particular, a heavy oil reservoir or tar sand, by penetrating the formation with a production well and an injection well, igniting the hydrocarbons in the deposit, injecting air to cause burning of a portion of the hydrocarbons in situ, and recovering hyrocarbons which are reduced in viscosity by the heat generated by the burning. Processes involving forward combustion wherein an oxygen-containing gas is injected into an injection well causing forward burning in the direction of a production well are known. Also known are reverse combustion processes wherein combustion is initiated in a production well with oxygen-containing gas injection from an injection well and movement of the firefront from the production to the injection well and production of hydrocarbons from the production well. It is also known to enhance the effectiveness of such fireflood processes by introduction of water into proximity with the burning zone.

Such combustion processes are disclosed to be particularly advantageously employed wherein the production well is the center well of a five-spot of nine-spot configuration when a forward combustion process is employed. Line drive configurations are also advantageously employed.

Advantageous and valuable though such processes are, certain problems are evident. Sweep efficiency of the front is often less than desirable because pressure and temperature are not high enough in the condensing steam zone preceeding the combustion front to fully mobilize the hydrocarbons in the formation. Also, because of the presence of reservoir irregularities such as high permeability streaks and/or fractures in the reservoir, the heat front may approach a producing well very rapidly in comparison to another producing well thus shortening the life of the recovery process and leaving substantial reserves in the reservoir. If the heatfront approaches a particular producing well more rapidly than the others, the well becomes hot early in the life of the project and presents considerable operating difficulties. Once the heatfront contacts such a production well, the well may also be lost. Our improvement invention provides a substantial advance in overcoming or mitigating such difficulties.

OBJECTS OF THE INVENTION

An object of the invention is to provide an improved combustion process for the recovery of liquid hydrocarbons from hydrocarbon-bearing subterranean formations.

This and other objects, advantages, and features of the invention will become apparent to those skilled in the art from a reading of the following detailed description.

SUMMARY OF THE INVENTION

According to the present invention, we have found an improved method for recovering liquid hydrocarbons from a hydrocarbon-bearing subterranean formation involving combusting a portion of the hydrocarbons in the formation. According to our invention, oil production rate is improved by increasing the pressure of the condensing steam front preceding the combustion front, as by throttling the production wells. Also according to our invention, combustion front movement in the formation can be controlled by retarding the advance toward or away from at least one of a plurality of production wells by throttling gas production from that production well to increase the gas pressure therein.

DESCRIPTION OF THE PREFERRED EMBODIMENTS

According to an aspect of our invention, the steam pressure in the locus ahead of an advancing combustion front is increased. This increased pressure has the effect of increasing temperature of the advancing condensing steam front and the effect of more effectively mobilizing hydrocarbons in the reservoir thereby greatly increasing sweep efficiency of the process. The steam front which preceeds the combustion front is formed from either natural reservoir water or injected water vaporized by the combustion front. The most effective mode of thus increasing the steam pressure is by throttling the production wells.

Typically, an advancing forward combustion front passing through a reservoir will have distinct fronts or zones associated with it which phase from the undisturbed reservoir to a burned zone following it. The usual sequence is: undisturbed zone, oil zone, water zone, condensing steam zone, coking zone, combustion zone, and burned zone. Of course, these zones in practice merge into each other. Reverse combustion has an analogous sequence of zones or fronts, which are well known to the art.

According to another aspect of our invention, the gas production in a forward combustion process is throttled at the production well in response to at least one of the following indicators of comparatively greater advance toward that production well than another production well: (a) a relatively greater gas production rate of the production well to be throttled in comparison to another production well, (b) a larger percent of oxygen in the gas comprised of oxygen, carbon dioxide and carbon monoxide which is produced from the production well to be throttled in comparison to the temperature of the subterranean formation in the vicinity of another production well, and (c) an increased temperature of the subterranean function in the vicinity of the production well to be throttled in comparison to the temperature of the subterranean formation in the vicinity of another production well.

Though the improved process of our invention can be employed in reverse combustion, that is wherein an oxygen-containing gas is injected into an injection well and hydrocarbons are produced from a production well with the combustion front moving from the production well to the injection well, it is most advantageously employed in a forward combustion mode, that is, wherein an oxygen-containing gas is injected into an injection well and hydrocarbons are recovered from a production well with movement of the firefront from the injection well toward the production well.

In the reverse combustion mode, the most advantageous application is in a line-drive configuration wherein a plurality of both production and injection wells are employed.

In the forward combustion mode wherein an oxygen-containing gas is injected into an injection well and hydrocarbons are produced from a production well, five-spot, nine-sot and line-drive configurations are presently preferred modes of operation.

In an inverted five-spot mode of operation, the injector well is the center well of the five-spot, and production wells comprise the other four spots of the configuration which resembles the configuration on dominos or dice from an overhead view. In other words, the injection well is in the center of a square, from an overhead view, with four production wells lying in the corners of the square.

The inverted nine-spot mode of operation is similar to the inverted five-spot, that is, the injection well lies in the center of a square, from an overhead view, with four production wells lying in the corner of the square and four more production wells each lying in a line between two corner wells.

In the line-drive mode of operation, a plurality of injection wells are employed to inject an oxygen-containing gas into a formation causing advance of a firefront in a more or less straight line toward a plurality of production wells in a more or less straight line parallel to a line intersecting the plurality of injection wells.

The improvement of the instant invention can be effected upon any conventional combustion process wherein a condensing steam front preceeds the combustion front such as those exemplified by the patents cited herein.

A presently preferred mode of operation involves throttling in a process wherein both an oxygen-containing gas and water are injected either concurrently, in sequence, or in combination of in sequence and concurrently.

The oxygen-containing gas can be air, pure oxygen, or mixture of oxygen and other gases. In one aspect, enriched air having above 80% oxygen content is advantageously employed. In another aspect, air is injected as the oxygen-containing gas.

Optimum ratios of oxygen-containing gas to water, sequence of injection, pressures of injection, well spacing, and the like are well known to those skilled in the art or can be readily calculated and determined by a skilled engineer with routine experimentation and use of his skill not amounting to invention.

In such combustion operations, liquid hydrocarbons are normally produced from production well through a pipe reaching from the surface to near the bottom of the well while gases such as combustion gases including oxygen, carbon dioxide, and carbon monoxide are produced through the well annulus between the casing and the pipe employed to produce the oil. Throttling is readily accomplished by reducing the amount of gas which is produced with a valve or the like so that a suitable back pressure is imparted to the well. Typically, back pressures of about 5 to about 15 pounds gauge are quite suitable. However, any back pressure can be imparted which retards the advance of the firefront between the injection and the production well which is throttled.

The advance of the combustion front between the injection well and the plurality of production wells is controlled for a maximum efficiency of the firefront by throttling the production well or wells which exhibit at least one of a relatively greater gas production rate, a larger percent of oxygen in the gas comprised of oxygen, carbon dioxide, and carbon monoxide which is produced, and an increased temperature of the formation in the vacinity of the well to be throttled in comparison to other production wells.

The relatively greater gas production rate of the production well to be throttled can readily be determined by conventional means such as flow meters or the like on the various production wells.

The percent of oxygen in the gas produced is readily determinable by conventional analyses methods.

Increased temperature of the subterranean formations in the vicinity of the production well to be throttled is readily determined by measuring the temperature of the liquid hydrocarbons and/or gas produced, by down hole sensors or by sensors in the formation between the injection and production wells which may be introduced therein by bores into the formation.

The back pressure produced by throttling of a selected production well lowers the pressure differential between the injection well and that producing well in relation to another production well. If throttling is excessive an undesirable reduction in oil production may occur. However, according to the invention, by a suitable optimization of throttling, undesirable reduction in oil production by such throttling is largely mitigated and the heat front advance can be controlled by throttling while at the same time maintaining suitable oil production.

Maintenance of oil production when a back pressure is applied to control the approach of the heat front is believed to be a result of taking advantage of the fact that the back pressure increases the temperature of condensing saturated steam near the combustion front which in turn significantly reduces the viscosity of the hydrocarbons mobilized and produced. Steam is formed from injected water or water naturally found in the formation. It is believed that the reduction in viscosity largely offsets the decrease in presssure differential between the injection well and the producing well which is throttled. By a proper combination of back pressure and reduction in viscosity due to increased temperature according to an optimum mode of operation, the well can be optimumly produced and at the same time the approach of the firefront can be retarded from the well which is being throttled thus effecting more efficient thermal recovery.

According to one presently preferred embodiment, throttling is effected in accordance with the following relationship:

The rate of oil production is given by:

$$q_o = \frac{7.08\ K_o h\ \Delta P}{\mu_o(T)\ B\ In\ \frac{r_e}{r_w}}$$

$h$ is pay thickness, ft.
$r_e$ is drainage radius, ft.
$r_w$ is wellbore radius, ft.
$\Delta P$ is pressure differential, psi
$\mu_o$ is oil viscosity, centiposse
T is temperature, °F
$k_o$ is permeability to oil, darey
$q_o$ is oil rate, Bbl per day
For a given $k_o$, h, $r_e$ and $r_w$ $$q_o = \frac{C\Delta P}{\mu_o(T)}$$

where C is a constant.

Thus, if $\Delta P_1$ and $T_1$ is the pressure differential and temperature prior to back pressure, and if $\Delta P_2$ and $T_2$ are the pressure differential and temperatures after applying back pressure, the ratio of oil rates can be calculated as follows:

$$\frac{q_{o_1}}{q_{o_2}} = \frac{\Delta P_1}{\mu_o(T_1)}\ \frac{\mu_o(T_2)}{\Delta P_2} = \frac{\Delta P_1}{\Delta P_2}\ \frac{\mu_o(T_2)}{\mu_o(T_1)}$$

Thus, oil production can be maintained or only minimially decreased as a result of optinal throttling according to the process of our invention.

In order to more fully explain the present invention, the following examples of how to carry it out are given. However, it is to be understood that these examples are not intended to function as limitations on the invention as described and claimed herein.

To illustrate the invention, a center injection well and four outlying production wells in an inverted five-spot configuration are drilled and completed into a formation of about 6,000 feet of depth. The formation is approximately 20 feet thick and is comprised of a porous and permeable sand reservoir containing a near saturation in the porous spaces with a very heavy bituminous petroleum and reservoir aqueous fluid.

Air injection is started into the injection well, and the formation in the vicinity of the injection well is ignited. Following a burning period of several weeks, water in controlled amounts is injected into the injection well to enhance recovery. Production of liquid hydrocarbons and combustion gas is effected from the production wells.

A gaseous back pressure is maintained on the production wells in accordance with the relationship heretofore provided.

Thereupon, it is observed that one of the production wells exhibits an increase in production of hydrocarbons and combustion gases in comparison to the other three production wells. The temperature in the vicinity of the well rises and the temperature of the fluids produced also rises. The percent of oxygen in the produced gas increases relative to the concentration of oxygen, carbon dioxide, and carbon monoxide in comparison to the other three production wells. These relative changes indicate that the firefront is channeling or differentially moving toward the production well exhibiting these changes.

Thereupon, the production well exhibiting the changes is throttled back exerting a gaseous back pressure in accordance with the relationship heretofore provided, but five pounds guage of gaseous pressure higher than the other production wells.

In response thereto, it is noted that production of liquid hydrocarbons is only minimally inhibited, but after a matter of several weeks, the other wells start exhibiting temperature, pressure, production, and analyses characteristics similar to the more throttled wells.

Thus, differential movement of the firefront is corrected and enhanced recovery is obtained according to the process of our invention.

What is claimed is:

1. In a forward combustion process for recovering hydrocarbons from a subterranean formation vertically traversed by an injection well through which an oxygen-containing gas is injected to maintain a period of combustion followed by a period of combustion maintained by injection of both water and an oxygen containing gas therethrough, and a plurality of production wells through which liquid hydrocarbons and gaseous products of combustion are produced, and wherein the process is characterized by movement of a combustion front preceeded by a condensing steam zone horizontally traversing the subterranean formation between the injection well and a production well; the improvement comprising: increasing pressure in the locus of the combustion zone and condensing steam zone and retarding combustion front movement with respect to at least one of the plurality of production wells after both water and an oxygen containing gas are injected through the injection well by throttling gas production from that production well to increase the gas pressure therein.

2. The process of claim 1 wherein the production is throttled in response to at least one of:

a. a relatively greater gas production rate of the production well to be throttled in comparison to another production well, b. a larger percent of oxygen in the gas comprised of oxygen, carbon dioxide, and carbon monoxide which is produced from the production well to be throttled in comparison to the gas produced from another production well, and c. an increasing temperature of the subterranean formation in the vicinity of the production well to be throttled in comparison to the temperature of the subterranean formation in the vicinity of another production well.

3. The process of claim 2 wherein the injection well is the center well is an inverted five-spot configuration.

4. The process of claim 2 wherein the injection well is the center well in an inverted nine-spot configuration.

5. The process of claim 2 wherein a plurality of injection wells are employed in a line-drive configuration.

* * * * *